United States Patent [19]

Meschi

[11] Patent Number: 4,729,813

[45] Date of Patent: Mar. 8, 1988

[54] SPLICING HEAD FOR SHEET MATERIAL

[76] Inventor: Luciano Meschi, Corso Amedeo 73, 57100 Livorno, Italy

[21] Appl. No.: 822,904

[22] Filed: Jan. 27, 1986

[30] Foreign Application Priority Data

Feb. 6, 1985 [IT] Italy ..... 20716/85[U]

[51] Int. Cl.[4] ..... B31F 5/00; B65H 69/06

[52] U.S. Cl. ..... 156/502; 156/157; 156/505; 242/58.1

[58] Field of Search ..... 156/157, 159, 304.1, 156/304.3, 502, 505, 506; 242/58.1, 59

[56] References Cited

U.S. PATENT DOCUMENTS 4,252,597 2/1981 Monroe ..... 156/505

4,421,590 12/1983 Meschi ..... 156/506

4,576,673 3/1986 Lenzi ..... 156/502

4,589,314 5/1986 Ralph et al. ..... 156/505

*Primary Examiner*—Michael Wityshyn

*Attorney, Agent, or Firm*—McAulay, Fields, Fisher, Goldstein & Nissen

[57] ABSTRACT

To splice the last sheet of a package of sheets or forms joined in a continuous strip and folded accordian-wise which are fed to a printer with the first sheet of the following package wherein there is provided a splicing plane made up of two semiplanes alignable on the splicing plane, sidewalls, which can be raised after splicing to disengage the spliced sheets from the positioning pins or rungs provided on the two semiplanes, are provided.

7 Claims, 2 Drawing Figures

SPLICING HEAD FOR SHEET MATERIAL

Figure 1:
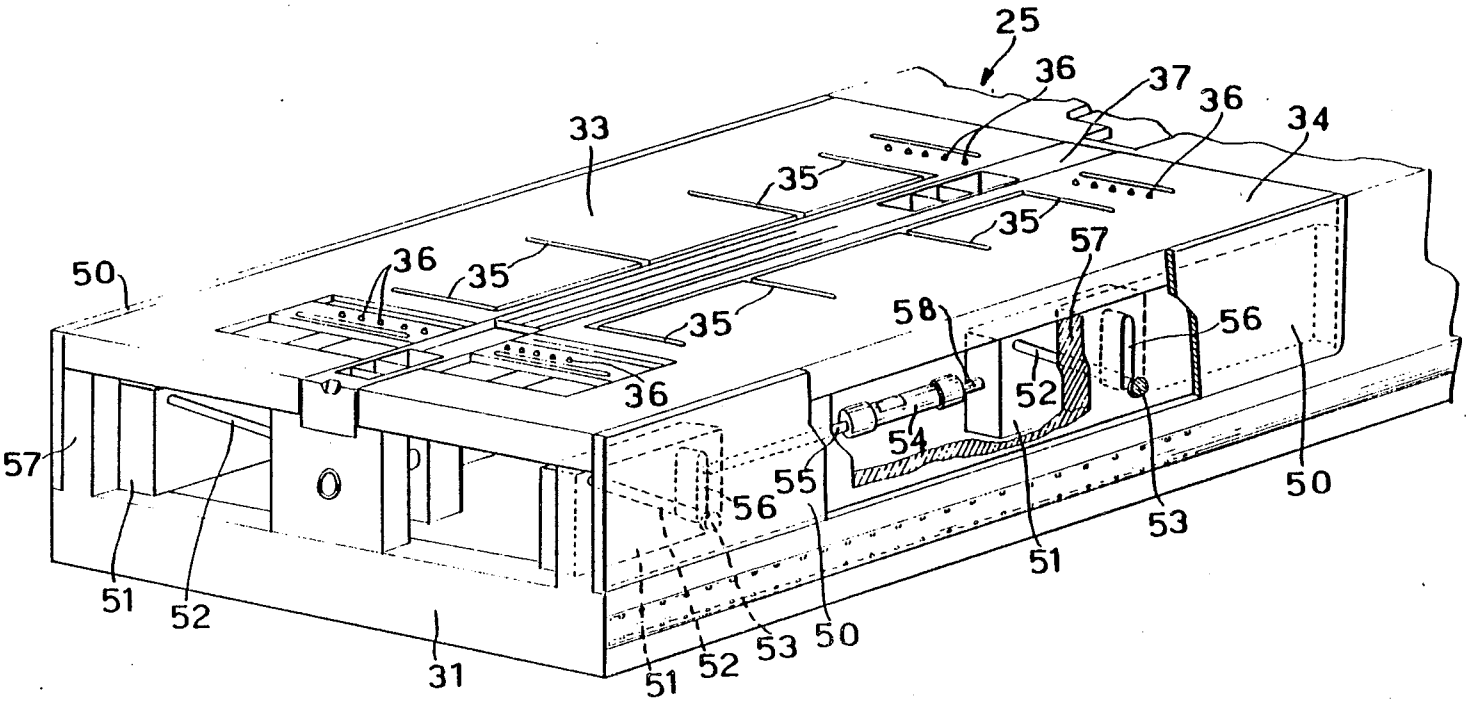

The present invention relates to a splicing head for sheet material, in particular for splicing of the last form or sheet of a package of forms or sheets joined together in a continuous strip and folded accordion-wise with the first form or sheet of an immediately following package.

In modern data processing centres, there are used very fast printers such as for example the so-called laser printers which are fed with the sheets or forms to be printed from packages of the above type. Given the very high operating speed of the printer the package of forms is exhausted in a very short time at the end of which a new package must be positioned to feed the printer. It is clear that manual positioning adopted until recently and still widespread today has a serious effect on the productivity of the printer and in the last analysis of the entire data processing centre, producing unacceptable down times.

In recent years the applicant has proposed and accomplished apparatuses designed to perform the automatic splicing of the last sheet or form, i.e. the bottom one, of the package being fed to the printer with the first form or sheet, i.e. the top one, of an immediately following package, thus avoiding interruption of the operation of the printer and eliminating the aforementioned down times.

This apparatus is the subject matter of U.S. Pat. No. 4,421,590 to which reference is made for further details. The applicant has also developed and accomplished a packing system for the packages of forms or sheets joined together in continuous strips and folded accordion-wise which allows easy withdrawal of the last sheet of the package of forms for splicing to a following package and the easy unfolding of the strip of forms or sheets feeding the printer. This is the subject matter of U.S. Pat. No. 4,458,814 and U.S. patent application Ser. No. 581,216.—

In the abovementioned apparatus the splicing takes place by means of a splicing plane divided in two semiplanes movable between an operating position in which they are coplanar and the contiguous edges of the two sheets to be spliced are rested and pressed on a strip of adhesive tape, having the adhesive side turned upward, and a positioning and adjusting position in which the two semiplanes are slightly inclined upwardly allowing positioning and fine adjustment of the edges of the two sheets to be spliced.

When the splice has been made the aforesaid splicing plane must be in some way withdrawn so as to allow transfer of the new packages into the position of the preceding one, which is now exhausted, and performance of a new splicing operation. In this step however since the sheets to be spliced are retained on the two semiplanes by vacuum and by the mating of the side holes of the sheets with the corresponding pins provided on the two semiplanes, difficulties may aries in the freeing of the spliced sheets from the pins, slowing removal of the splicing plane by lowering or retraction.

The main object of the present invention is to avoid these drawbacks. It therefore provides in a splicing apparatus of the above type an improvement consisting of arranging along the two opposing edges of said splicing plane parallel to the splicing line sidewalls movable in a controlled manner between a rest or lowered position in which they are flush with the splicing plane and an operating or raised position in which they protrude a predetermined distance above said splicing plane so that they raise the two spliced sheets from the splicing plane, disengaging them from the positioning pins.

The peculiar aspects and advantages of the present invention will appear more clearly from the detailed description given below with reference to the annexed drawings as nonlimitative examples.

Figure 2:
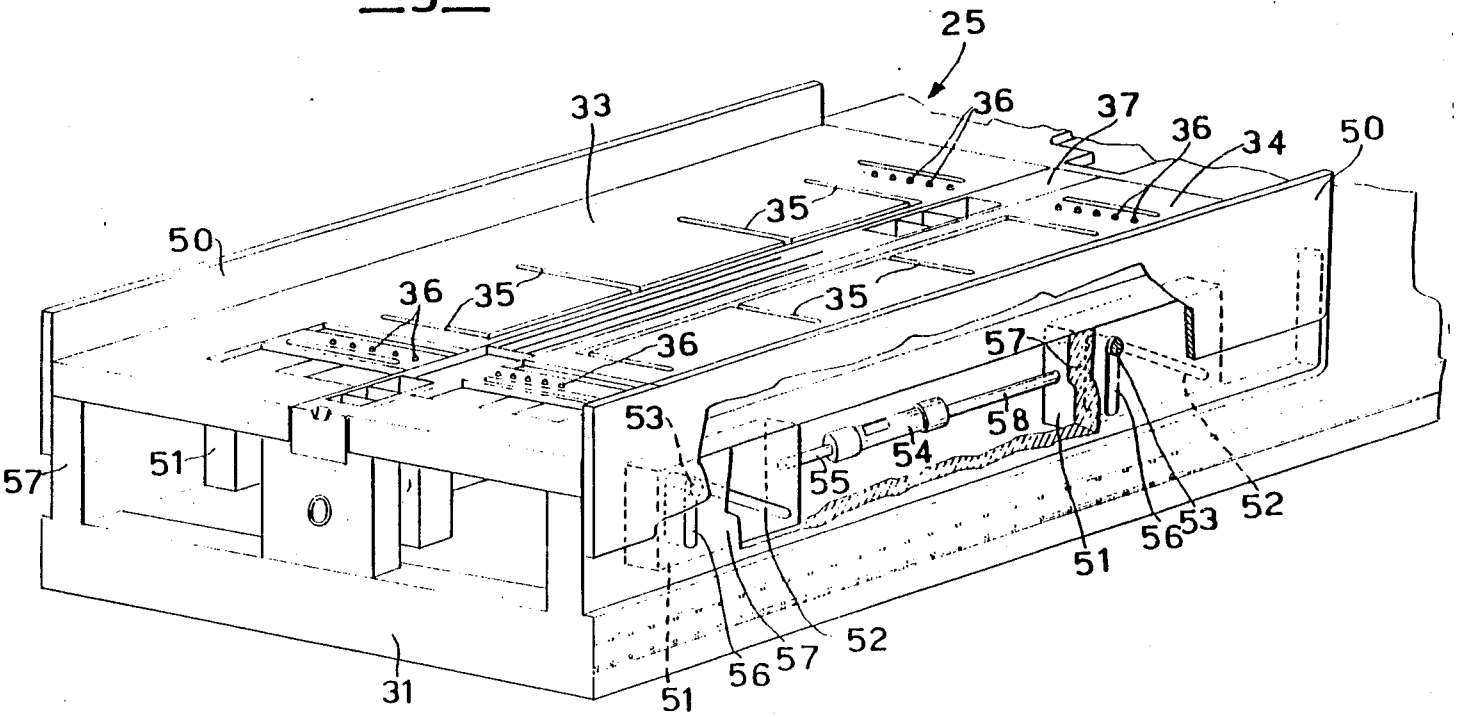

In the drawings:

FIG. 1 is a perspective view of the splicing plane making up part of the apparatus covered in the above mentioned patent applications with the sidewalls in rest position, and FIG. 2 is a view similar to that of FIG. 1 but with said walls in working position.

As shown in the figure the splicing plane 25 consists of two semiplanes 33 and 34 which in FIG. 1 are shown coplanarly and rested on a central splicing block 37 on the top surface of which the splicing is performed. On the two semiplanes are provided pins or rungs 36 for positioning and retaining the sheets to be spliced, a function which is combined with slits 35 which communicate with a vacuum source. For further details on the structure and operation of the two semiplanes, as well as their driving, reference is made to the aforementioned patent applications. Along the outer and opposing edges of the splicing plane i.e. along the outer edges of the two semiplanes 33 and 34, are provided two sidewalls 50 housed in a lowered seat made in the thickness of the frame 31 which supports the splicing semiplanes. Said sidewalls are movable vertically between the positions shown in FIGS. 1 and 2 in the latter of which they protrude in relation to the top surface of the splicing plane 25.

To move the sidewalls 50 between the position of FIGS. 1 and 2 said sidewalls ae rigidly integral with blocks 51 which are housed below the related splicing semiplane, the blocks 51 being designed to slide parallel to the lie plane of the sidewalls 50 and also parallel to the corresponding splicing semiplane. In each block 51 is made a groove or slot 52 arranged diagonally in relation to the related block, which has a rectangular shape. This groove is the slide way for a pin 53 which is rigidly integral with the sidewall 50 and which therefore constitutes the aforesaid connection between the wall and the block. The pin 53 also passes in a vertical slot 56 made in the end wall 57 which separates the sidewall 50 of the slide way of the blocks 51 between which is mounted a cylinder unit 54 and two pistons connected to the stems 55 and 58 respectivelly, each of which is connected to one of the blocks 51. The cylinder and piston assembly is present in such a manner that when it is operated one stem is extended and the other withdrawn, applying the related action to the corresponding block. Therefore, from the position of FIG. 1 the action applied to the respective block forces the corresponding pin 53 to slide in the groove or slot 52 so that the sidewalls are forced to slide upward and take the position shown in FIG. 2.

In this position, if a splicing operation of the two sheets or forms has just been completed, raising of the sidewalls 50 lifts the sheets from the splicing plane 25 just enough to disengage said sheets from the positioning pins or rungs 36 and hence from the splicing plane which can then be lowered or caused to slide backward.

At this point by operating the cylinder and piston assembly the blocks 21 are returned to the position of FIG. 1 and the walls 50 are again lowered to their rest position.

The splicing operation can now be repeated with two more sheets or forms and so on.

It is understood that the drive means of the two sidewalls 50 between the lowered and raised positions can be different from, but equivalent to those above mentioned thus remaining within the scope of the present invention. In the same manner the position of the sidewalls 50 can be modified, their function remaining unchanged, i.e. raising the sheets just spliced above the splicing plane just enough to disengage them from the positioning pins thus allowing the splicing plane to be disengaged from said sheets to the last sheet of the package of sheets being fed to the printer can be made to translate when the package of sheets being fed is exhausted without interrupting feeding of the printer, after which the splicing operation with the first sheet of the following package is repeated.

I claim:

1. A sheet material splicing head for splicing apparatuses of the type for splicing two sheets together, comprising:

a splicing plane formed of two semiplanes movable between a lowered or working position in which they are coplanar and a position slightly inclined upwardly for positioning and adjustment of the two sheets to be spliced;

positioning pins on each of said two semiplanes for positioning and retaining the sheets to be spliced;

movable sidewalls along two outer opposite edges of said splicing plane parallel to a splicing line, said sidewalls being movable in a controlled manner between a rest or lowered position in which they are flush with said splicing plane and an operating or raised position in which they protrude a predetermined distance above said splicing plane; and means for driving said sidewalls between said two positions so that they raise the two spliced sheets from the splicing plane, disengaging them from the positioning pins;

said drive means including:

at least one block for each said sidewall and associated therewith, each said block sliding parallel to the lie plane of its said associated sidewall and each said block having a slot arranged in an inclined position along a diagonal, a sidewall pin rigidly integral with a said sidewall for each said block and housed in the related slots, and a cylinder assembly associated with each said sidewall with two opposing pistons, the stems of which are rigidly integral with said blocks so that operation of said cylinder assemblies and opposing pistons brings about sliding of said blocks and sliding of said sidewall pins in their respective slots, forcing the corresponding sidewalls to descend and rise depending on the direction of sliding of the blocks.

2. The splicing head in accordance with claim 1, including an end wall for each said sidewall, each said end wall having a vertical slot for receiving one of said sidewall pins for movement thereof vertically in relation to said end wall.

3. The splicing head in accordance with claim 1, including two of said blocks for each said sidewall, and an end wall for each said sidewall, each said end wall separating said sidewalls from said blocks, each said end wall having a vertical slot for receiving one of said sidewall pins for movement thereof vertically in relation to said end wall.

4. A sheet material splicing head for a splicing apparatus of the type for splicing two sheets together in a continuous strip, comprising:

a splicing plane formed of two semiplanes, and means for splicing the two sheets together in a continuous strip;

positioning pins on each of said two semiplanes for positioning and retaining the sheets to be spliced;

movable sidewalls along two outer opposite edges of said splicing plane parallel to a splicing line, said sidewalls being movable in a controlled manner between a rest or lowered position in which they are flush with said splicing plane and an operating or raised position in which they protrude a predetermined distance above said splicing plane;

means for driving said sidewalls between said two positions so that they raise the two spliced sheets in their spliced condition as a unit from the splicing plane, for disengaging them from the positioning pins as a unit;

said driving means including:

a pair of drive blocks associated with each said movable sidewall, each sliding parallel to the lie plane of its said associated sidewall and each said block having a slot arranged in an inclined position along a diagonal, a sidewall pin rigidly integral with a said sidewall for each said block and housed in the related slots, and a cylinder assembly with two opposing pistons for each said pair of blocks, the stems of which are rigidly integral with said blocks so that operation of said cylinder assemblies and opposing pistons brings about sliding of said blocks and sliding of said sidewall pins in their respective slots, forcing the corresponding sidewalls to descend and rise depending on the direction of sliding of the blocks; and an end wall separating each said side wall from each said pair of drive blocks, each said end wall having a vertical slot for receiving one of said sidewall pins for movement thereof vertically in relation to said end wall.

5. A sheet material splicing head for a splicing apparatus of the type for splicing two sheets together in a continuous strip, comprising:

a splicing plane formed of two semiplanes, and means for splicing the two sheets together in a continuous strip;

positioning pins on each of said two semiplanes for positioning and retaining the sheets to be spliced;

movable sidewalls along two outer opposite edges of said splicing plane parallel to a splicing line, said sidewalls being movable in a controlled manner between a rest or lowered position in which they are flush with said splicing plane and an operating or raised position in which they protrude a predetermined distance above said splicing plane;

means for driving said sidewalls together between said two positions including a drive block for each said movable sidewall so that they raise the two spliced sheets in their spliced condition as a unit from the splicing plane, for disengaging them from the positioning pins as a unit;

a sidewall pin rigidly integral with a said sidewall for each said block, each said block having an inclined slot for housing one of said sidewall pins; and an end wall associated with each said drive block, each said end wall having a vertical slot for receiving one of said sidewall pins for movement thereof vertically in relation to said end wall.

6. The splicing head as claimed in claim 5, including:

a pair of drive blocks for each of said side walls, both of said blocks of each said pair of drive blocks sliding parallel to the lie plane of its said associated sidewall and each said block having said slot arranged in an inclined position along a diagonal; and a cylinder assembly with two opposing pistons for each said pair of blocks, the stems of which are rigidly integral with each block of said pair of blocks so that operation of said cylinder assemblies and opposing pistons brings about sliding of said blocks and sliding of said sidewall pins in their respective slots, forcing the corresponding sidewalls to descend and rise depending on the direction of sliding of the blocks.

7. The splicing head in accordance with claim 6, wherein each said end wall separates each said sidewall from each said pair of drive blocks.

* * * * *